United States Patent [19]

Olson et al.

[11] Patent Number: 4,966,651

[45] Date of Patent: Oct. 30, 1990

[54] METHOD OF PAPER MAKING USING AN ABRASIVE REFINER FOR REFINING BLEACHED THERMOCHEMICAL HARDWOOD PULP

[75] Inventors: Robert A. Olson, York New Salem; Lewin R. Lutz, III, York, both of Pa.

[73] Assignee: P.H. Glatfelter Company, Spring Grove, Pa.

[21] Appl. No.: 296,022

[22] Filed: Jan. 12, 1989

Related U.S. Application Data

[63] Continuation-in-part of Ser. No. 143,843, Jan. 14, 1988, abandoned.

[51] Int. Cl.[5] ..... D21C 1/02; D21C 9/00

[52] U.S. Cl. ..... 162/28; 162/25; 241/28

[58] Field of Search ..... 162/20, 23, 28, 261, 162/24, 25; 241/28

[56] References Cited

U.S. PATENT DOCUMENTS

| | | | |
|---|---|---|---|
| 1,814,587 | 7/1931 | Daniels | 241/261.2 |
| 3,028,634 | 4/1962 | Coghill | 241/261.2 |
| 3,117,603 | 1/1964 | Van Kevren et al. | 146/182 |
| 3,240,437 | 3/1966 | Horstman | 241/261.2 |
| 3,622,091 | 10/1972 | Bidwell | 241/222 |
| 3,827,934 | 8/1974 | Ringley et al. | 167/28 |
| 4,023,737 | 5/1977 | Leider et al. | 241/261.3 |
| 4,023,739 | 5/1977 | Lampe et al. | 241/296 |
| 4,090,672 | 5/1978 | Ahrel | 241/261.1 |
| 4,372,495 | 2/1983 | Marton et al. | 241/28 |
| 4,620,675 | 11/1986 | Kirchner | 241/261.3 |

FOREIGN PATENT DOCUMENTS

| | | | |
|---|---|---|---|
| 1089273 | 11/1980 | Canada | 162/28 |
| 1104856 | 7/1981 | Canada | 162/261 |
| 730916 | 5/1980 | U.S.S.R. | 241/261.3 |
| 2026897 | 2/1980 | United Kingdom | 241/261.2 |

OTHER PUBLICATIONS

Miles et al., "Abrasive-Filled Refiner Plates in Thermo-mechanical Pulping", paper presented at 74th Annual meeting of the Technical Section, Canada Pulp & Paper Assoc., Montreal, Canada, Jun. 26-29, 1988.

Stationwala, M. I., "Abrasive Refiner Plates for the Production of Mechanical Pulp"; Tappi Pulping Conf., Toronto, pp. 237-241; Oct. 1986.

*Primary Examiner*—Steve Alvo

*Attorney, Agent, or Firm*—Fisher, Christen & Sabol

[57] ABSTRACT

An improved paper for printing and other uses can be made from a paper pulp that contains pulp derived from hardwoods if the pulp is refined in a refiner that has at least one abrasive surface disk. The pulp can be refined to give a vessel picks count of $2/cm^2$ or less and have a Freeness of less than that which can be achieved using a refiner having conventional barred disks.

15 Claims, No Drawings

METHOD OF PAPER MAKING USING AN ABRASIVE REFINER FOR REFINING BLEACHED THERMOCHEMICAL HARDWOOD PULP

This application is a CIP of Ser. No. 07/143,843 filed Jan. 14, 1988, and now abandoned.

BACKGROUND OF THE INVENTION

This invention relates to a method for making paper products using hardwood paper pulps. More particularly, this invention relates to a method for processing hardwood pulps to produce a pulp that when made into a paper product has improved printability.

Paper products are made from a variety of fiber sources. In the United States, paper products are usually made from either softwoods or hardwoods. The softwoods are the evergreen trees which are also known as conifers. The hardwoods are the deciduous trees. Typical hardwoods are oak, maple, poplar, eucalyptus, birch, chestnut, aspen, beech and walnut. Both softwoods and the hardwoods provide good sources of fiber for making various paper products. The softwood sources have a longer fiber, about 3 to 4 millimeters in length as compared to the hardwood sources where the fiber length is about 1 to 1.5 millimeters. However, while the softwood fibers generally have a larger diameter, the hardwoods have fibers that are of a smaller diameter and yield a paper with a smoother texture. Paper products are made from softwood pulp, hardwood pulp and from mixtures hardwood and softwood pulp. The type of product being produced and the pulp sources on hand will many times dictate the composition of the pulp to be used.

In the manufacture of higher quality printing papers, it is desirable to use a large percentage of hardwood pulp because of its superior opacity, ability to reduce apparent density, improved formation and favorable economics. However, one problem with regard to the use of hardwood pulps results from the basic structure of hardwoods. Hardwoods contain two principal cell types. These are fiber cells and vessel element cells. The vessel element cells are that part of the hardwood tree that transports water and nutrients from the root system up into the tree. The vessel element cells are not fibrous in nature. Consequently, they do not add to the strength or quality of the paper. Quite the opposite, these vessel elements after undergoing digestion, bleaching and conventional refining are still present and are mixed into and onto the paper product. The problem in printing is caused by the vessel elements that remain on the surface of the paper product. The large unbonded vessel elements on the surface of the sheet get picked from the surface by the printing roll during the printing operation. This results in ink not being applied to all parts of the paper where it was intended to be applied and also to the problem of these vessel elements remaining on the printing roll and causing undesirable spots or voids during the printing of subsequent copies. The net result is a printed paper which is not of the intended quality.

This problem associated with the vessel elements in paper products being lifted from the paper during printing is a longstanding problem. This problem came to be realized on a broad scale in the 1950's when the use of bleached hardwood pulp increased dramatically in printing papers. Many solutions have been tried over the years. The only one to have achieved any commercial success is to coat a sheet of paper with a starch solution. The starch solution films over and/or pastes the vessel elements to the sheet preventing them from being picked off during printing. However, this increases the cost of the paper since another substance must be added during the manufacture of the paper. It has now been found that this problem of the picking of vessel elements from the paper surface during printing can be alleviated through the use of a particular refining technique after the hardwood has been formed into a pulp.

It has been found that if after the hardwood has been formed into a pulp using any of the known thermochemical digestion processes the hardwood pulp is refined in a refiner wherein at least one of the refiner disks has an abrasive surface the problem of vessel picks is alleviated. In conventional processing after the digestion of the hardwood source, the fiber is sent to a refiner containing standard metal surfaced disks. These disks which can contain bars on the surface work the fibers in order to produce a more homogeneous pulp. After one or more passes through the refiner, the pulp is pumped to the headbox of a paper machine for conversion into the paper product.

Pulp refiners having abrasive surface disks are known in the art. In U.S. Pat. No. 4,372,495 there is disclosed a process and apparatus for comminuting wood chips to form a pulp using a disk refiner having abrasive disks. The feed material is wood chips and the end product is a ground wood. In the example in this patent, Southern Pine chips are converted into a thermo-mechanical pulp using this type of a disk refiner. This patent discloses the disk refining of large pieces of wood rather than of a digested pulp.

U.S. Pat. No. 3,117,603 discloses an apparatus having abrasive surface sectors which is used for grinding rejects as well as for other uses. However, there is no disclosure with regard to the refining of a pulp derived from hardwoods.

U.S. Pat. No. 3,827,934 discloses the digestion of hardwood chips. Subsequent to digestion there is a step of hot stock refining and subsequent to washing there is a step of refining. Neither of these steps of refining is disclosed to be conducted using a refiner having abrasive surface disks.

U.S. Pat. No. 1,814,587 discloses a pulp refining apparatus which has a pair of relatively rotatable abrasive stones. However, there is no disclosure in this patent with regard to the types of pulps to be used nor that any unusual benefit to the pulp occurs.

Russian patent No. 730,916 discloses an apparatus for the grinding of fibrous suspensions in the production of paper. It is disclosed that the fibrous material is first beaten by blades of a metal ring and then the slurry is subject to action by the projections of a ceramic disk. The abrasive grains of the ceramic disk are described to act as micro-knives which card out the microfibrils. However, there is no disclosure with regard to the processing of hardwood pulps. There is also no indication that the fibers in suspension benefit from this process.

None of these patents disclose the benefits of processing a hardwood derived pulp in a refiner which has one or more abrasive surface disks. Also, none of these patents is directed to solving the problem of vessel picks with regard to hardwood fiber sources. As noted above, those in the art have resorted to using starch and related materials to bind the vessel elements to the surface of the paper. This is an effective solution but it is not ideal.

The present solution approaches the ideal in that the pulp must be refined in any regards. Consequently, this is not an added step. The refining of the pulp in a particular refiner using a particular technique, very effectively solves the problem.

BRIEF SUMMARY OF THE INVENTION

The present invention is directed to the refining of a hardwood pulp in a refiner wherein at least one of the disks of the refiner has an abrasive surface. By abrasive surface is meant that the surface of the disk which is usually flat, but can be of other shapes, and has applied thereto a randomly dispersed particulate abrasive material. The abrasive material can be a carbide such as tungsten carbide or silicon carbide, aluminas, zirconias, silicas and diamond. Essentially any known abrasive in particulate form can be used. The abrasive preferably will be in a particle size range of about 20 mesh to 120 mesh, and most preferably in a particle size range of about 30 mesh to about 40 mesh. The abrasive will cover from about 10 percent to about 90 percent of the surface of the disk in a randomly distributed manner.

A hardwood source usually in the form of chips is digested using any known thermochemical digestion process. This can be a kraft process, sulfide process or soda process. After the wood has been digested to remove the lignin content, the pulp consists of discrete fibers. These discrete fibers are then refined in a refiner which contains at least one disk having an abrasive surfaced disk as described above. Preferably the refiner consists of a series of disks wherein one disk has an abrasive surface and the facing disk has a metal surface which contains a plurality of bars. This disk which contains the plurality of bars will usually not contain any abrasive on its surface. The refining of a digested hardwood pulp in such a refiner reduces the size of the vessel elements to a size where they become interwoven into the fibers and are thereafter maintained within the fiber matrix. A paper produced from this pulp will have vessel picks per $cm^2$ of less than about 5, and preferably of less than about 3. A paper made from such a pulp does not experience the problem of pieces of the vessel elements being lifted from the paper during printing. In the production of paper products this hardwood pulp can be used alone or can be intermixed with a softwood pulp. Mineral pigments are often added to the pulp to improve the opacity of the paper.

DETAILED DESCRIPTION OF THE INVENTION

The present invention is directed to the unexpected discovery that the vessel elements in a hardwood pulp can be effectively reduced in size and interwoven into the fibers if refined in a refiner wherein at least one of the disks of the refiner contains an abrasive surface. It is common to refine a hardwood pulp, as it is to refine other pulps, prior to the pulp being pumped to the headbox of a paper machine. The traditional refiner consists of an apparatus which contains two or more disks with the disks having bars attached onto the surface. The bars are essentially elongated bar shaped projections attached to and extending outwardly from the disk surface to thereby work on the fiber that is passing between the disks. These bars are usually rectangular in shape. A typical refiner will have one or more stationary disks and one or more rotating disks, or in the alternative will have two or more rotating disks. In the traditional refiner, each of these disks will usually have bars attached to and extending from the surface of the disks.

The typical disk refiners when used to process hardwood pulps will serve to fibrillate the hardwood fibers in the pulp. A usable pulp is produced. Even though the paper product made from this pulp is surface treated with starch or some other substance there is a problem of vessel elements being picked from the surface during printing. By refining a hardwood pulp in a refiner wherein at least one of the disks has an abrasive surface, that is, a disk that has randomly dispersed particulate abrasive attached to the surface, the particulate vessel elements from the hardwood tree which are present in the pulp are broken down to smaller fragments which become interwoven into the fibers and held by the fibers. By becoming interwoven into the fibers, these fragments of the vessel elements are not picked from the surface of the paper product during printing operations. The result is a higher quality printing with a longer interval of operation between stops to clean the printing press.

The material that is refined is a hardwood pulp and not hardwood chips. A hardwood pulp is the product of the thermochemical digestion of hardwood chips. The digestion removes the lignin and allows separation of the fibers. If hardwood chips are refined there is produced a ground wood mixture of small to large fiber pieces plus the unremoved lignin. The lignin can be up to about 50 percent of the material. The Shopper-Reigler Freeness of this ground wood will be well in excess of 35° S-R. This will have very poor drainage on the paper machine. In addition, even after further refining this ground wood will not be useful for producing high quality printing papers due to its tendency to become yellow and brittle with age. This is a result of its lignin content.

Essentially any disk refiner having at least one disk with a particulate randomly distributed abrasive on its surface can be used in the practice of the present invention. One disk refiner that can be used is that disclosed in U.S. Pat. No. 4,372,495 which is incorporated herein by reference. However, the present invention is not restricted to the use of this disk refiner. The particulate abrasive that is on the surface of the disk can be as course as 5 mesh or as fine as 200 mesh. A 5 mesh piece of abrasive material would just pass through a 5 mesh screen having openings of 4 millimeters while a 200 mesh material would just pass through a 200 mesh screen having openings of 0.07 millimeters. It is preferred that the abrasive have a size of at least about 20 mesh to about 120 mesh and most preferably a size of about 30 mesh to about 40 mesh. The abrasive material can be essentially any known abrasive. These include carbides such as tungsten carbide and silicon carbide, aluminas, zirconias, silicas and diamond. The particulate abrasive will cover from about 10 percent to about 90 percent of the surface area of a disk, and preferably about 30 percent to 70 percent of the surface area of a disk.

In the production of the present hardwood pulps the hardwood logs are first sent to a chipper or similar apparatus to reduce the size of the logs to pieces of about 0.125 inch to about two inches. Preferably the pieces are of a dimension of about 0.37 inch to about one inch. These hardwood chips are then sent for thermochemical digestion using a kraft process, a sulfide process or a soda process. Any of these processes can be used with the choice being one of personal preference.

For instance, a process such as the process described in U.S. Pat. No. 3,827,934 can be used. After digestion, the fibers are then washed to remove the digestion chemicals to yield a brownstock fiber. The brown stock fiber is then bleached using essentially any known bleaching chemicals and bleaching sequence. Typical bleaching chemicals include chlorine, chlorine dioxide, sodium hypochlorite, ozone, and hydrogen peroxide. Other traditionally used pulp bleachants can also be included into or substituted into the bleaching process. The objective is to produce a pulp which can be used to produce a white paper product or, by the addition of dyes, a range of colored papers. After bleaching the white pulp is then refined to fibrillate the fibers prior to the fibers being pumped into the headbox of the paper machine. It is at this point that the hardwood fibers are refined in a refiner wherein at least one of the refiner disks has an abrasive randomly dispersed over at least a part of the surface.

In the process of the present discovery the bleached hardwood pulp that exits the refiner can be sent directly to the headbox of the paper machine or can be admixed with softwood pulp and the combined mixture sent to the headbox of the paper machine. If mixed with a softwood pulp, the softwood pulp can be in a concentration of from about 5 percent to about 95 percent of the fiber content of the mixture. Likewise in such a mixture the hardwood fiber content can be present in an amount of about 5 percent by weight to about 95 percent by weight of the fiber content of mixture. If desired the softwood pulp and the hardwood pulp can be mixed prior to refining and the combined pulps refined together in the refiner containing at least one disk having an abrasive surface. However, it is preferred that the hardwood pulp be refined separately and then combined with the softwood pulp.

The resulting hardwood pulp that is produced in the present process will have a pulp consistency of preferably between about 5 percent and about 35 percent, and most preferably between 10 percent and about 15 percent. The pulp consistency is the percent of solids in the pulp. The pulp freeness increases following a refining step. The more working of the fiber in the refiner, the greater will be the increase in the pulp freeness. The pulp freeness is a measure of the rate at which water drains from the pulp. In the making of paper, water drainage is important. For many paper-making applications a pulp freeness or °S-R (Shopper-Reigler number) should be below about 40° S-R, preferably below about 35° S-R and most preferably below about 30° S-R. Pulps with a freeness higher than this drain too slowly on the paper machine causing decreased production and increased energy consumption in the final drying of the sheet paper product. The pulp freeness of a hardwood pulp prior to refining is usually about 20° S-R. Following a refining step wherein the refiner has at least one of the above-described abrasive surface disks, the pulp freeness increases, but remains below about 40° S-R and preferably below about 35° S-R for a paper having a low vessel picks count. However, when a conventional refiner is used, that is one with a barred surface, the pulp freeness is increased to above 40° S-R in order to produce a paper where the problem of vessels being picked up from the paper during printing is similarly reduced.

Another important factor in determining the efficiency of a refining operation is the brake horsepower days per air dried tons of pulp (BHPD/ADT) produced. The amount of BHPD/ADT used can range from about 1 to about 100. It is desired that the BHPD/ADT be the minimum needed in order to produce an acceptable product. In the present process the number of whole vessel elements per gram is significantly reduced as the horsepower is increased as is the number of vessel picks per square centimeter. Also the use of an abrasive surface on one or more of the refiner disks will decrease the whole vessels per gram to less than one half the level when a barred surface disk is used in the refiner. The vessel picks per square centimeter are reduced by about 28 percent using a refiner having barred surface disks and by about 96 percent when using the present abrasive surface disks. This is a significant difference. The use of a refiner having at least one of the present abrasive surface disks provides a paper product having superior quality properties. If it is desired to refine a hard wood pulp using these different refiners in order to produce an equivalent product, that is one having whole vessel elements of 100,000 or less per gram, and preferably 60,000 or less per gram of pulp and vessel picks of 5 or less, preferably of 3 or less, and most preferably 2 or less per square centimeter of paper surface, the horsepower used will be about 15 BHPD/ADT when the refiner has one or more abrasive-surfaced disks versus more than 30 BHPD/ADT when the refiner uses the conventional barred-surfaced disks. This results in a significant savings in the electric power requirement to produce an air dried ton of paper product.

In addition, there is the advantage that when the paper product that is produced has this level of vessel elements of 60,000 or less per gram of pulp and vessel picks of 2 or less per square centimeter of paper surface, the freeness will be about 40° S-R or below, and preferably 35° S-R or below, and most preferably about 30° S-R or below, for a pulp refined in a refiner having abrasive-surfaced disks while a pulp refined in a refiner having barred-surface disks will have a freeness of above about 40° S-R to about 50° S-R. Consequently, the paper produced from a hardwood pulp which has been refined in a refiner using the abrasive surface disks will have increased drainage on the paper machine over such a pulp refined in a barred-surface refiner to the same level of vessel elements and vessel picks.

In addition, a paper made from the hardwood pulps of this invention will have a higher tensile strength for a given pulp freeness. At pulp freeness values of less than 30° S-R, the tensile strength of the resulting paper will be in excess of 7.2 kg/25 mm. This is a distinct advantage to have a better draining pulp produce a higher strength paper product.

There are yet other still undiscovered advantages in the refining of a hardwood pulp in a refiner which utilizes one or more abrasive surface disks. However, such advantages that are achieved in the refining of a hardwood pulp would be considered within the scope of the present invention.

The following examples are set forth to further show and illustrate the benefits achieved when a hardwood pulp is refined in a refiner wherein at least one of the refining disks has an abrasive surface.

TEST PROCEDURES

Vessel Element Count

The number of whole vessel elements in hardwood pulp were visually counted using a microscope. Prior to counting, all pulp samples were stained with C-stain. C-stain is a chemical provided by the Institute of Paper Chemistry to aid in the visual examination of wood fibers. Counts are expressed in the number of whole vessel elements per gram of pulp.

Vessel Picks

The vessel picking test was performed on handsheets made from the refined hardwood pulp. These handsheets were prepared according to Technical Association of the Pulp and Paper Industry (TAPPI) Standard Procedure No. 205.

The vessel picking test uses an IGT Printability tester Model AC2. The print is made using O/S Paper Test Jay Blue ink made by the Capitol Ink Company. Picks are determined visually with a microscope. Their number is expressed as the number of vessel picks/cm$^2$.

Shopper-Reigler Freeness °S-R

The Shopper-Reigler freeness is determined using the procedure of the Technical Association of The Pulp and Paper Industry Standard No. 227—Freeness of Pulp.

Consistency

The consistency is determined using the procedure of the Technical Association of the Pulp and Paper Industry Standard No. 240—Consistency (Concentration) of Pulp Suspension.

Tensile Strength

The tensile strength of a paper is determined using the procedure of the Technical Association of the Pulp and Paper Industry Standard No. 494—Tensile Breaking Properties of Paper and Paperboard (Using a Constant Rate of Elongation Apparatus). All tensile values are determined with paper having a basis weight of 61 g/cm$^2$.

EXAMPLE 1

This example discloses a representative method for producing a bleached kraft hardwood pulp as used in plant operations. The hardwood pulp is produced from hardwood sources consisting of about 65 percent oak and about 35 percent other hardwoods. The oak source is primarily red oak and white oak. The other hardwoods are mostly maple and poplar.

The hardwood sources are formed into chips of about 0.18 to 0.87 inches thick. The chips are oven dried and 4000 grams of these hardwood chips are charged to a digester. The digestion cooking liquor was prepared by combining sodium hydroxide, sodium sulfide and sodium carbonate such that the resulting solution contained about 22 percent by weight (should be between 19–25 percent) active alkali (calculated as $Na_2O$), 20 percent sulfidity and 80 percent causticity. The ratio of cooking liquor to wood by volume was 4 to 1.

After the addition of the cooking liquor the digester is sealed and the temperature raised over a period of 1 hour to 330° F. The digester was maintained at this temperature for 1.5 hours. The pressure in the digester at this temperature was 110 psi.

Following digestion, the digested fiber is blown down to atmospheric pressure and the pulp drained of digestion chemicals. The drained pulp is washed with a countercurrent flow of water to further remove digestion chemicals and then bleached. The pulp is bleached using a chlorine-alkali extraction-sodium hypochlorite-chloride dioxide bleaching sequence. After bleaching, the bleached pulp is washed with water to remove bleaching chemicals. The bleached pulp will have a GE Brightness of about 83. This bleached pulp is then pumped to the headbox of a paper machine.

EXAMPLE 2

The material that is refined in this Example is a bleached kraft hardwood pulp taken from a plant production run. This hardwood pulp is refined in a Sprout-Waldron refiner Model 105A. This refiner is operated at 1200 revolutions per minute and at atmospheric pressure. The abrasive surface disk is 12 inches in diameter and has tungsten carbide grit of about 36 mesh plasma randomly bonded to the surface.

About 50 percent to 60 percent of the disk is covered with the abrasive grit. The abrasive surface disk is a stationary disk. The rotating disk is a barred disk. The barred disks are of a type commonly used for refining wood pulp for printing papers. These disks are 12 inches in diameter and have bars 1.5 to 3.5 inches in length on the surface in a radial array. The horsepower applied ranged from 0.5 to 15 BHPD/ADT. This was controlled by opening or closing the distance between the stationary and rotating disk, changing pulp consistencies, or both.

Table I shows properties of this pulp before and after processing in a refiner having the above abrasive surface disk arrangement. As shown in this Table the number of whole vessel elements and vessel picks are greatly reduced, 250,000 to 60,000/g, and 25 to 1/cm$^2$, respectively. The greater the horsepower applied, the greater the reduction. At 15 BHPD/ADT the number of whole vessels was reduced by 76%, and the vessel picks reduced by 96%.

TABLE I

Properties of Hardwood Pulp Before and After Abrasive Disk Refining

| Horsepower Applied BHPD/ADT* | Whole Vessel/gram | Vessel Picks/cm$^2$ |
|---|---|---|
| 0 | 250,000 | 25 |
| 5 | 140,000 | 22 |
| 10 | 110,000 | 10 |
| 15 | 60,000 | 1 |

*Brake Horsepower Day/Air Dried Ton

EXAMPLE 3

Bleached kraft hardwood pulp from a plant production run is refined in a refiner equipped with an abrasive surface disk as described in Example 2 and in another refiner equipped only with conventional barred disks as also described in Example 2. One barred disk is a stationary disk and one is a rotating disk. Both refiners are operated at 1200 revolutions per minute and at atmospheric pressure. A comparison of the results is shown in Table II.

As shown in this Table abrasive surface disk refining is more energy efficient using less horsepower than barred disk refining in reducing both the number of whole vessels and vessel picks. At 15 BHPD/ADT, whole vessels are reduced from 250,000 per gram to 60,000 per gram using the present abrasive surface disk and to 140,000 per gram using barred surface disks. These represent reductions of 76% vs 44% respectively. A similar pattern is shown for vessel picks. Using the abrasive surface disk, vessel picks are reduced from 25/cm$^2$ to 1/cm$^2$ while using conventional barred disks the vessel picks are reduced from 25/cm$^2$ to 18/cm$^2$. These represent reductions of 96% vs 28% respectively.

TABLE II

A Comparison of Pulp Properties
Abrasive Surface Disk vs Conventional Barred Disks Refining

| | Hardwood Pulp "as received" | Abrasive Surface | Barred Surface |
|---|---|---|---|
| Horsepower applied (BHPD/ADT) | 0 | 15 | 15 |
| Whole vessels/gram | 250,000 | 60,000 | 140,000 |
| Vessel Picks/cm$^2$ | 25 | 1 | 18 |

*Brake Horsepower Day/Air Dried Ton

EXAMPLE 4

Bleached kraft hardwood pulp from a plant production run is refined using the same refining as that used in Example 2. The abrasive surface disk refiner and the barred surface disk refiner were similar to those used in Example 2. The refiners are operated at 1,200 revolutions per minute and at atmospheric pressure. A comparison is shown in Table III as to the affect on freeness. As previously discussed, it is desirable for papermaking to keep freeness below 35° S-R.

TABLE III

Comparison of Resulting Freeness
Abrasive Surface Disk vs Conventional Barred Disk

| | Freeness °S-R | |
|---|---|---|
| Targeted Reduction | Abrasive Surface | Barred Surface |
| Whole vessel elements 60,000, or less/gram | 32 | 48 |
| Vessel Picks 2/cm$^2$ or less of paper surface | 33.5 | 45 |

As shown in Table III, both disk types could reduce the number of whole vessels to the target value of 60,000 per gram of pulp or less. However, in doing so, the refiner equipped with barred disks increased pulp freeness from an unrefined value of 20° S-R to 48° S-R. This is well above the maximum desired pulp freeness of 40° S-R and preferred freeness of 35° S-R. The refiner equipped with an abrasive surface disk as described herein, while accomplishing the same re-duction in whole vessels, only increased freeness to 32° S-R.

Both disk types, as shown in Table III, can also be used to reduce vessel element picks in a paper to 2/cm$^2$ of paper surface or less. In doing so, freenesses are again increased. The refiner equipped with barred plates increased freeness from 20° S-R for unrefined pulp to 45° S-R. Again this is above the maximum desired freeness of 40° S-R and preferred freeness of 35° S-R. The refiner equipped with the present abrasive surface disks only increased freeness to 33.5° S-R.

EXAMPLE 5

Bleached kraft hardwood pulp from a plant production run is refined using a disk refiner equipped with an abrasive surface disk and a barred surface disk. The disks and their arrangement is the same as used in Example 2. The refiner is operated at 1,200 revolutions per minute with a fixed plate gap of 0.0003 inches and at atmospheric pressure. Table IV shows the effect of pulp consistency on the reduction in vessel picks per cm$^2$. As shown in this Table, the higher the consistency, the greater the reduction in vessel picks. In this example a consistency of 13% was used and vessel element picks were reduced to the target value of 2/cm$^2$ or less.

TABLE IV

The Effects of Hardwood Pulp Consistency
on the Reduction in Vessel Element Picks
Using an Abrasive Surface Disk

| Consistency | Vessel Picks/cm |
|---|---|
| 5 | 19 |
| 7 | 15 |
| 9 | 11 |
| 11 | 7 |
| 13 | 2 |

EXAMPLE 6

Paper is made from bleached kraft hardwood pulp refined in a refiner equipped with an abrasive surface disk as described in Example 2, and in another refiner equipped with conventional barred disks as also described in Example 2. The refiners are operated at 1,200 revolutions per minute and at atmospheric pressure. A comparison of the resulting freenesses and tensile strengths is shown in Table V.

TABLE V

A Comparison of Freeness and Tensile Strength
Abrasive Surface Disk vs Conventional Barred Disk

| | Freeness | Tensile (Kg/25 mm) |
|---|---|---|
| Abrasive Surface Disk | 23.5 | 7.2 |
| | 25.0 | 7.6 |
| | 26.9 | 8.2 |
| | 28.4 | 8.6 |
| | 32.0 | 9.6 |
| Barred Surface Disk | 31.0 | 7.3 |
| | 31.9 | 7.5 |
| | 41.0 | 8.3 |
| | 46.9 | 8.8 |
| | 48.9 | 8.9 |

As shown in this table, tensile strength is dependent on the freeness developed during refining. In this example as freeness, in °S-R, increases, tensile strength increases. In general, the stronger a sheet of paper the better. It is therefore important that any refining technique not produce a reduction in tensile strength. Excess refining can cause strength decreases.

On examining the data for the two refining techniques, particularly where the resulting freeness values overlap, one finds that for a given level of freeness, the tensile strength achieved with the abrasive disk refiner is greater than that achieved with a barred disk refiner. At a freeness of 30° S-R, the tensile strength of a sheet made with abrasive disk refined pulp had a value of 9.0 Kg. while that from pulp refined with barred plates, only 7.2 Kg.

Abrasive disk refining has a distinct advantage in producing higher tensile strength at lower freeness value Freeness values above 40° S-R, and preferably above about 35° S-R, are not desireable for routine papermaking. Pulp refined with barred disks to have a tensile strength of 9 Kg. would have a resulting freeness of 50° S-R. Pulp with a freeness this high would not be suitable for routine papermaking.

What is claimed is:

1. A method for improving a paper made from a paper pulp containing pulp thermochemically derived from hardwoods comprising bleaching the thermochemically derived hardwood pulp, refining the bleached hardwood containing pulp in a refiner having a particulate randomly dispersed abrasive on at least one of the surfaces of the refiner disks, said abrasive being dispersed over at least a substantial portion of said surface of said disk which most directly comes in contact with said pulp during refining wherein the whole vessels per gram and the vessel picks per square centimeter of the paper produced by said method are reduced to a lower level for a given Freeness °S-R than when said at least one of the surfaces of the refiner disks does not have the particulate randomly dispersed abrasive over at least a substantial part of said surface of said disk thereon.

2. A method for improving a paper made from a paper pump containing pulp derived from hardwoods as in claim 1 wherein said hardwoods are selected from the group consisting of oak, maple, poplar, birch, chestnut, aspen, beech, eucalyptus, walnut and mixtures thereof.

3. A method for improving a paper made from a paper pulp containing pulp derived from hardwoods as in claim 1 wherein said refiner has at least one stationary disk and at least one rotating disk.

4. A method for improving a paper made from a paper pulp containing pulp derived from hardwoods as in claim 1 wherein said refiner has at least two rotating disks.

5. A method for improving a paper made from a paper pulp containing pulp derived from hardwoods as in claim 3 where said refiner contains at least one barred surface disk.

6. A method for improving a paper made from a paper pulp containing pulp derived from hardwoods as in claim 4 wherein said refiner contains at least one barred surface disk.

7. A method for improving a paper made from a paper pulp containing pulp derived from hardwoods as in claim 3 wherein each pulp contacting surface of each disk has a randomly dispersed particulate abrasive thereon.

8. A method for improving a paper made from a paper pulp containing pulp derived from hardwoods as in claim 3 wherein the surface of each disk having an abrasive surface contains an abrasive having a mesh size of from about 5 mesh to about 200 mesh.

9. A method of improving a paper made from paper pulp containing a pulp derived from hardwoods as in claim 3 wherein the surface of each disk having an abrasive surface contains an abrasive having a mesh size of from about 20 mesh to about 120 mesh.

10. A method for improving a paper made from a paper pulp containing pulp derived from hardwoods as in claim 9, wherein the surface of each disk having an abrasive surface contains an abrasive having a mesh size of about 30 mesh to about 40 mesh.

11. A method for improving a paper made from a paper pulp containing pulp derived from hardwood sources as in claim 1 wherein the abrasive on said disk is selected from the group consisting of tungsten carbide, aluminas, zirconias, silicas, silicon carbide, diamond and mixtures thereof.

12. A method for improving a paper made from a paper pulp containing pulp derived from hardwoods as in claim 1 wherein each abrasive surfaced disk has abrasive covering about 10 percent to about 90 percent of the area of the surface of the disk that contacts the pulp.

13. A method for improving a paper made from a paper pulp containing pulp derived from hardwoods as in claim 1 wherein each abrasive surface disk has abrasive covering about 30 percent to about 70 percent of the area of the surface of the disk that contacts the pulp.

14. A method for improving a paper made from a paper pulp containing pulp derived from hardwoods as in claim 1 wherein said paper pulp also contains softwood pulp.

15. A method for improving a paper made from a paper pulp derived from hardwoods as in claim 1 wherein the Freeness S-R of the pulp is less than about 35°.

* * * * *